United States Patent [19]

Maglecic

[11] Patent Number: 4,607,478

[45] Date of Patent: Aug. 26, 1986

[54] APPARATUS FOR PACKAGING BULK MATERIALS COMPOSED OF ELONGATED PIECES

[76] Inventor: Steven C. Maglecic, 4041 S. Mitchell, Boise, Id. 83709

[21] Appl. No.: 702,352

[22] Filed: Feb. 15, 1985

[51] Int. Cl.[4] ..... B65B 1/32

[52] U.S. Cl. ..... 53/502; 53/151; 53/544; 53/551

[58] Field of Search ..... 53/525, 522, 151, 544, 53/551, 552, 451, 446, 444, 502; 193/44

[56] References Cited

U.S. PATENT DOCUMENTS

| | | | |
|---|---|---|---|
| 1,047,984 | 12/1912 | Phifer | 53/525 |
| 2,549,322 | 4/1951 | McKinsey | 53/525 |
| 2,632,588 | 3/1953 | Hoar, Jr. | 53/525 X |
| 3,861,121 | 1/1975 | Monsees | 53/551 X |
| 4,096,938 | 6/1978 | Payne | 53/151 X |
| 4,144,693 | 3/1979 | Ogata | 53/552 X |
| 4,514,959 | 5/1985 | Shroyer | 53/525 X |
| 4,519,179 | 5/1985 | Meier | 53/525 X |

*Primary Examiner*—Horace M. Culver
*Attorney, Agent, or Firm*—Paul F. Horton

[57] ABSTRACT

Apparatus and method for the packaging of bulk materials composed of elongated pieces. The apparatus and method are particularly useful in the packaging of food materials such as french fries, carrots, celery hearts, and the like. The method includes the steps of weighing and apportioning the material, separating the material into individual pieces, causing free-fall of the pieces resulting in substantial alignment and guiding the pieces into a fill tube for packaging. Apparatus for packaging includes apportioning buckets, a transition chute with a stream-out member, a fill tube, and a packager. A bag catcher for settling the product within the package may also be provided.

13 Claims, 5 Drawing Figures

APPARATUS FOR PACKAGING BULK MATERIALS COMPOSED OF ELONGATED PIECES

BACKGROUND OF THE INVENTION

1. Field of the Invention

This invention relates, in general, to packaging methods and apparatus, and, in particular, to methods and apparatus for the packaging of food materials composed of elongated pieces, such as french fries.

2. Description of the Prior Art

Currently, bulk food materials composed of separate elongated pieces are placed in packages in a random order when packaged by machine and are placed in an aligned order only when packaged by hand. Such random packaging results in a considerable increase in bagging material per weight unit of the material packaged and also results in a requirement for considerably greater area resulting in inefficiency in shipping of the packaged material.

Hand alignment of the elongated food pieces is undesirable because of cost inefficiency and health considerations. Further, hand packaging for alignment of the pieces is simply impossible for foods such as pre-fried french fries which are extensively used in the fast food industry. Apparatus and methods for aligning such food material is currently unknown.

SUMMARY OF THE INVENTION

The present invention solves the problem of alignment of food materials such as french fries, resulting in a substantial increase in cost efficiency by reducing the amount of bagging material used per weight unit and also by reducing the packaged volume for shipping.

The method of the present invention includes, generally, the measuring and apportioning of selected amounts of the material, separating the pieces comprising the material from one another, causing free-fall of the pieces, guiding the pieces which are substantially aligned by the free-fall into a fill tube, and packaging the material.

The apparatus of the present invention includes measuring apparatus; a transition chute for separating elongated pieces composing the material, for causing free-fall of the pieces, and for guiding the pieces into a fill tube; a fill tube for receiving the pieces; and a packager for packaging the aligned material. A more thorough description of the invention may be found in the appended claims.

It is therefore a primary object of the present invention to provide a method of packaging bulk material composed of elongated pieces by aligning the pieces within the package through the steps of separating individual pieces; allowing the pieces to free-fall; and guiding the free-fallen pieces into a fill tube for packaging.

A further primary object of the present invention is to provide apparatus for aligning elongated pieces of bulk material for packaging.

More particularly, it is an object of the present invention to provide a method and apparatus for aligning elongated food pieces, and for aligning french fries for packaging, in particular, with resultant efficiency in packaging and shipping.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
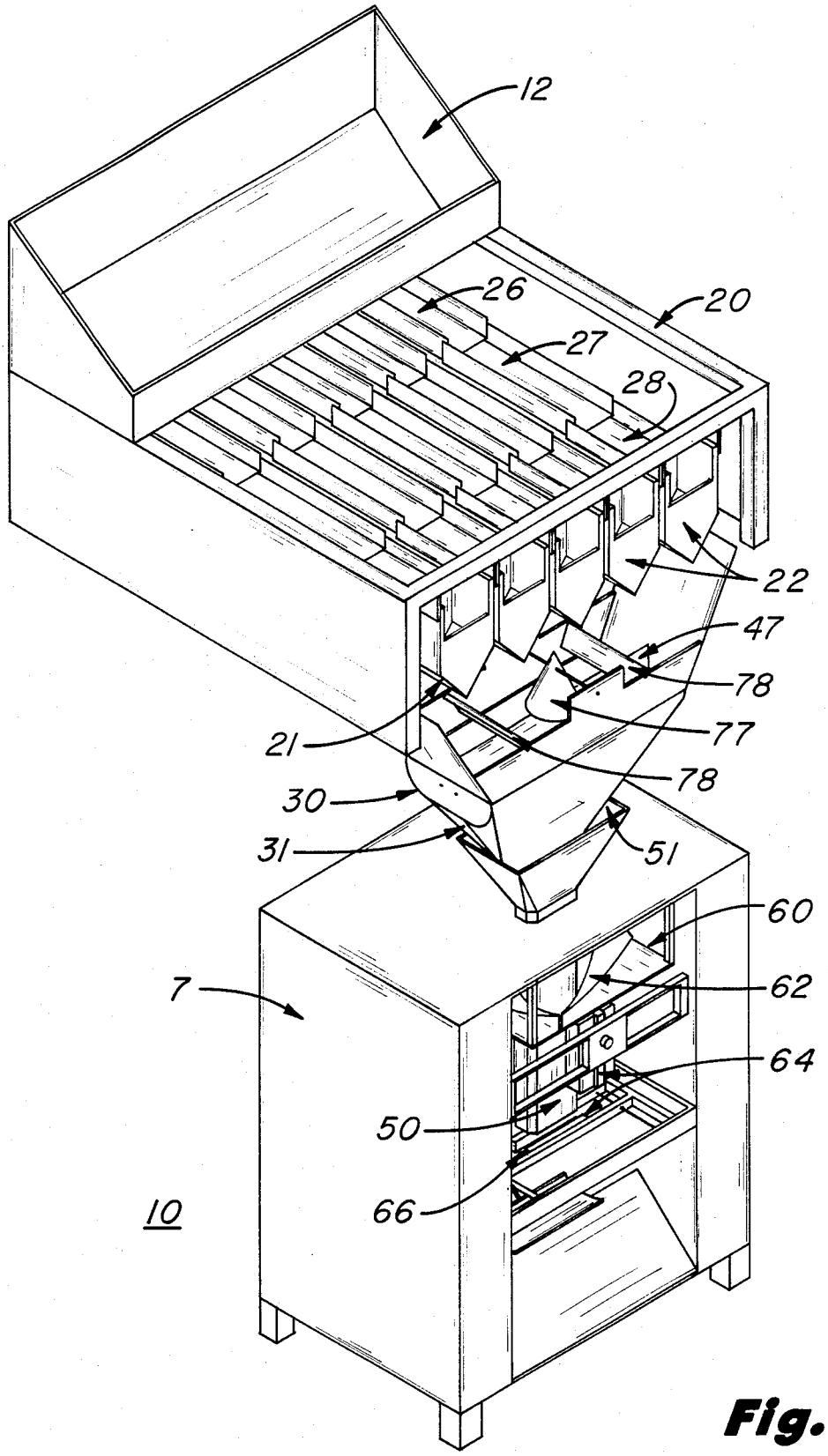
FIG. 1 is a perspective view of a preferred embodiment of the apparatus of the present invention.

Referring now to the drawings, an embodiment to be preferred of a packaging device made according to the present invention and a flow diagram of the process of the present invention are disclosed.

Packaging device 10 includes, generally, measuring means 20, a transition chute 30 including a stream-out member 40, a fill tube 50, and means 60 for enveloping the material to be packaged in a selected bagging material. Packaging device 10 is used for bulk materials composed of elongated pieces for substantial alignment of the pieces for cost reduction in the use of less packaging material such as plastic or paper wrap per weight unit and also for a reduction in shipping costs because of greater density per package. While device 10 may be used for any bulk materials composed of elongated pieces, it is believed that its primary value will be in the food packaging industry, in general, and particularly in the packaging of bulk quantities of french fries, and therefore the following description shall be confined to the packaging of french fries, with an understanding that a similar device may be used for other bulk materials composed of elongated pieces. Device 10 is particularly useful in the packaging of french fries because of the light weight, the narrow width, and the length of the individual fries composing the bulk.

Figure 2:
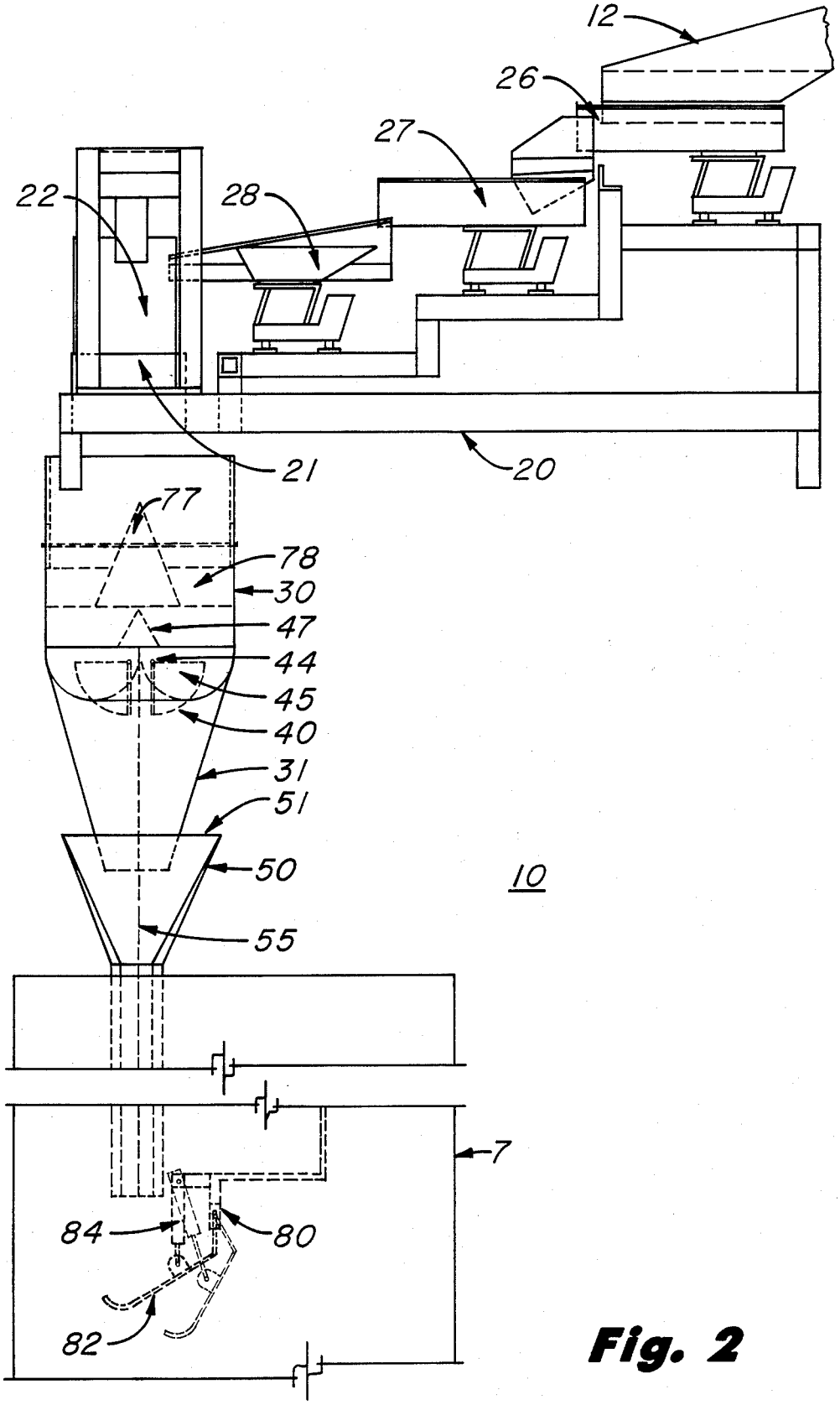
FIG. 2 is a side view sketch of the apparatus.

Measuring means 20 of device 10 may be in the form of either volumetric measurement means or weighing means. Volumetric measurement means may simply include one or more buckets, designated by the numeral 22, filled to capacity with bulk material, the elongated pieces of which are in random order. Most often, however, and particularly in the french fry industry, the bulk material, in this case composed of elongated strips of potato, must be apportioned into package units by weight, and therefore weighing means are required. In that the weighing means of the present invention is conventional in the art, only a short description will be given in that those skilled in the art will be fully aware of the weighing means. Weighing means 20 preferably includes a series of vibrating pans operable to receive a bulk quantity of fries from an overhead bin 12 and deliver the same to weight buckets 22, as shown in FIG. 2. A rear main vibrating pan 26 feeds the fries to a second vibrating pan 27 which in turn feeds the fries to a third vibrating pan 28 which in turn dumps the fries into one of several of the weight buckets 22. Once a weight bucket has received a selected weight of fries, for example 5 lbs., as determined by one or more weight cells, not shown, vibrating pan 28 ceases vibrating, thereby preventing further delivery to the weight bucket. The weight buckets, having electronically controlled retention flaps 21, then open to release the fries to the transition chute.

Transition chute 30 may be funnel-like in construction having side walls 31 operable to guide the french fries to fill tube 50. Mounted within the side walls 31 is a stream-out member 40 which includes two or more stream-out flaps 45—preferably two only. Flaps 45 each pivot from a substantially horizontal position to a substantially vertical position. Flaps 45 may be pivoted to one another or to a common laterally extending framework 44 as shown in FIG. 2. Above the pivot point of the two flaps and directly below each bucket 22 is a laterally extending deflector 47 which effectively separates the bulk materials, i.e., the french fries, into two equal portions, each portion being received upon the top surface of each of the flaps. Located above deflector 47 and directly below the center bucket 22 is a cone 77 and located at each side above the deflector and below the end buckets are a pair of side baffles 78 which, together with the cone, aid in a more even distribution of the product onto the flaps 45 of the stream-out member 40. Each flap member is caused to pivot by an air cylinder or other control device, not shown, causing the gradual release of the french fries placed thereon, i.e., the streaming-out of the fries in a free-fall to the interior side surfaces of the transition chute. The streaming-out process effectively separates the individual fries from one another and causes the substantial alignment of the individual fries relative to one another. While the cause for the alignment is not completely clear, it is believed that the individual fries, having an elongated shape, in the free-fall, align themselves to the path of least air resistance which is a vertical position and maintain a substantial vertical position as they enter the fill tube 50.

Fill tube 50 is provided with at least one top opening 51 for receiving the fries from the transition chute and preferably includes a divider 55 vertically extending along the longitudinal axis for the length of the tube, effectively dividing the top opening 51 of the tube into two openings. The divider maintains the separation of the fries into two substantially equal portions while in the fill tube and is used for further alignment of the french fries, as will hereinafter be explained. It is preferable that divider 55 extend into transition chute 30 up to and adjacent with the pivotal axis of flaps 45, as shown in FIG. 2. One divider is therefore used to separate both the transition chute and the fill tube.

Figure 4:
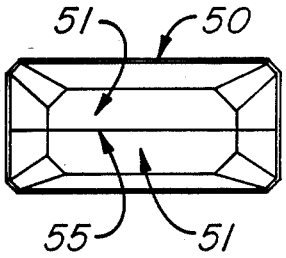
FIG. 4 is a sectional view of the fill tube of the present invention taken along lines 4—4, FIG. 3.

Referring to FIG. 4, the top openings 51 of fill tube 50, each narrow to an inside length of 9.5 inches and an inside width of 2.5 inches from side wall to divider. It is important that the width of each of the top openings be less than the average length of the elongated pieces comprising the bulk material. The average length of french fries is approximately 3 inches. The width of each opening is 2.5 inches. Such structure effectively eliminates those fries exceeding 2.5 inches in length from entering the fill tube in a crosswise, i.e., a horizontal-width position, therefore causing further alignment of the fries.

Packaging means 60 is old in the art and well known in the industry and therefore a brief description will be given of said means. Various types of packaging means may be employed, it being preferred to utilize a form-fill-seal machine comprising a former 62 for forming the package film or wrapping about the fill tube 50, the outside surface of which determines the package size; sealer 64, operable to make both vertical and horizontal seals with the packaging material; and separator 66 which separates the finished package, filled with substantially aligned fries of predetermined weight, from the packaging film.

Figure 3:
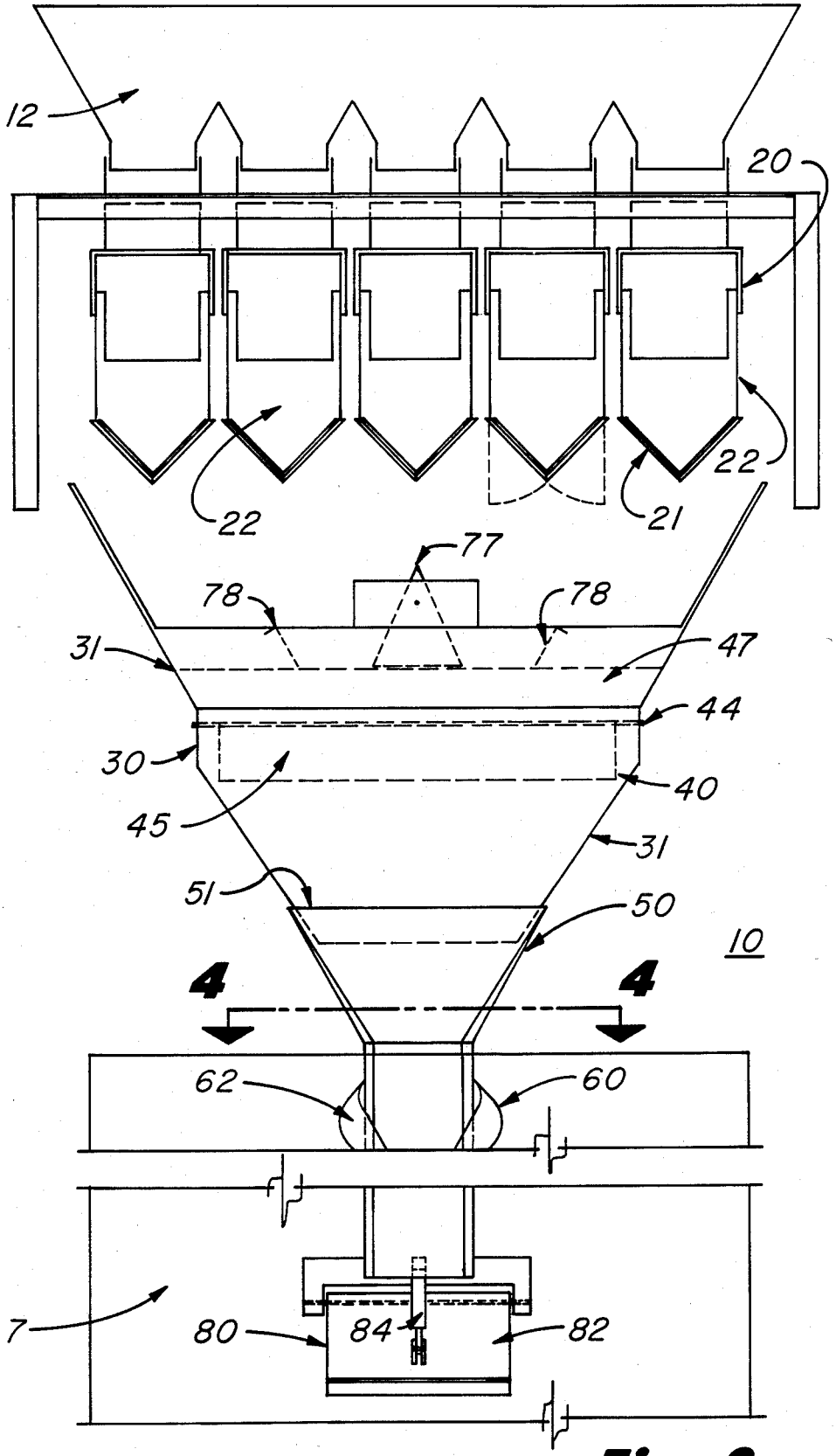
FIG. 3 is a front view sketch of the apparatus.

Positioned below fill tube 50 is a bag catcher 80 which provides support to the undersurface of the package to aid in the proper filling of the bag and by settling the aligned material in the bag by shaking. Bag catcher 80, fill tube 50, and packaging means 60 are supported by a framework 7 positioned below transition chute 30. Bag catcher 80 includes a bag retention platform 82 for supporting a package and an air cylinder 84, computer controlled, for settling the product and also for releasing the package by pivoting the platform, as shown to advantage in FIGS. 2 and 3.

Figure 5:
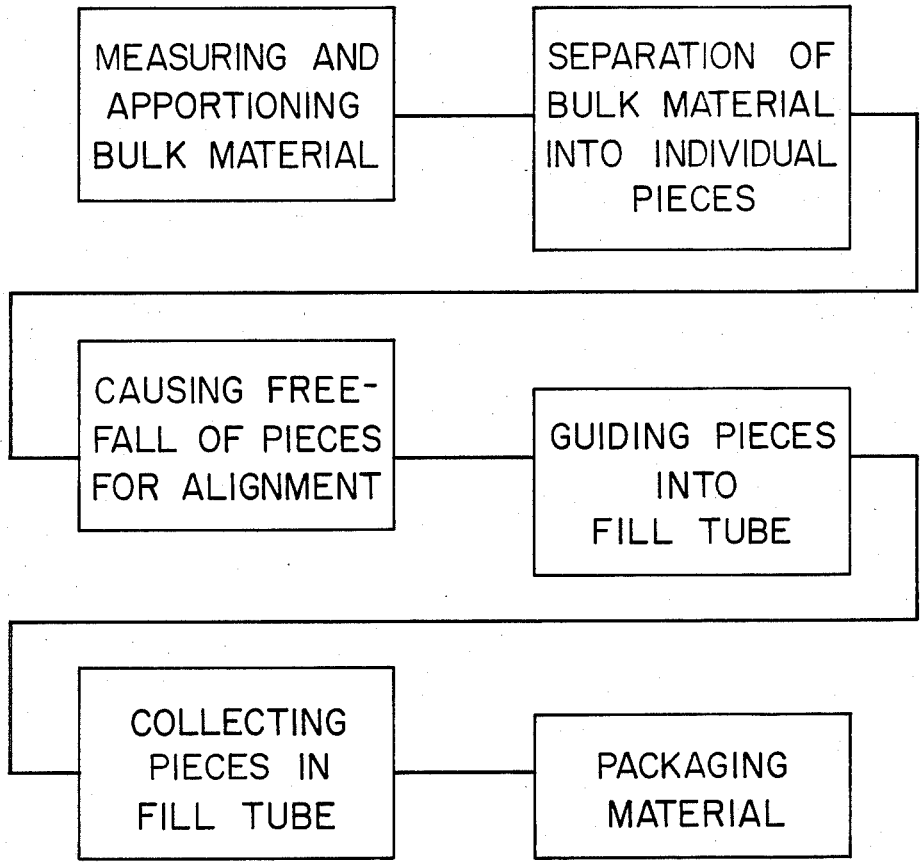
FIG. 5 is a flow diagram of the process of the present invention.

The process or method of the present invention will be explained by use of the apparatus as above-described, although it will be apparent that other apparatus may be used in the process or, alternatively, certain steps of the process may be accomplished manually. A flow chart of the general process may be seen in FIG. 5.

In operation, the bulk fries located within bin 12 are transported by means of vibrating pans 26–28 to one of the weight buckets 22. After a pre-selected weight of the fries, as determined by a weight cell, has entered the bucket, the bucket empties the apportioned amount onto deflector 47, causing substantially equal amounts of the bulk fries to fall on the upper surface of each of the horizontal flaps 45 of stream-out member 40. As the flaps 45 are gradually lowered toward a vertical position, the fries separate from one another to a substantial degree as they slide down and off each of the flaps, thus "streaming out" the fries. Once leaving the flaps, the fries are in a free-fall mode in which substantial alignment of the fries occurs—the individual elongated fries tending to assume a vertical position. The fries then engage the interior side walls of the transition chute 30, maintaining their aligned position as they are guided into fill tube 50.

As the fries enter the fill tube, fries exceeding a predetermined length which may have assumed a horizontal position relative to the width of the opening, i.e., a non-aligned position, are restricted from entering the tube until they have assumed a different position, further in alignment with the rest of the fries. The fries are then collected within the two sections of the fill tube, striking the packaging material at the bottom end of the tube or other fries already within the tube in a substantially vertical position and then falling to a horizontal position laying longitudinally within each of the tubes sections in substantial alignment. The aligned fries may then be settled within the bagging package by means of bag catcher 80. The bag is appropriately formed and sealed and then separated from the remaining bagging material by the former, sealer, and separator, respectively, thus completing the process.

Having thus described in detail a preferred selection of embodiments of the present invention, it is to be appreciated and will be apparent to those skilled in the art that many physical changes could be made in the apparatus and other changes could be made in the process without altering the inventive concepts and principles embodied therein. The present embodiments and methods are therefore to be considered in all respects as illustrative and not restrictive, the scope of the invention being indicated by the appended claims, rather than by the foregoing description, and all changes which come within the meaning and range of equivalency of the claims are therefore to be embraced therein.

I claim:

1. A packaging device for bulk materials comprised of a multiplicity of elongated pieces, said packaging device comprising:

means for quantitatively measuring selected amounts of said materials;

a transition chute for receiving said materials and guiding said materials to a fill tube, said chute including at least one stream-out member to substantially separate material pieces from one another and to cause free-fall of the pieces for substantial alignment thereof;

a fill tube for receiving the substantially aligned pieces; and packaging means for enveloping the substantially aligned material received from said fill tube in bagging material.

2. The apparatus as described in claim 1 wherein said fill tube is provided with a top opening for receiving material to be packaged from said transition chute; the width of said opening being less than the average length of the elongated pieces comprising the bulk material for further alignment of the material.

3. The apparatus as described in claim 1 wherein said fill tube includes a divider for separating the tube into at least two equal portions, each portion provided with a top opening for receiving material to be packaged from said transition chute; the width of each of said openings being less than the average length of the elongated pieces comprising the bulk material for further alignment of the material.

4. The apparatus as described in claim 1 wherein said measuring means includes volumetric measurement means.

5. The apparatus as described in claim 1 wherein said measuring means includes weighing means.

6. The apparatus as described in claim 5 wherein said weighing means includes one or more vibrating pans for holding and discharging the bulk material; one or more weigh buckets for receiving the bulk material from said vibrating pans; and one or more weigh cells for determining the weight of material within each of said buckets.

7. The apparatus as described in claim 1 wherein said transition chute includes a divider for maintaining separation of material portions separated by said stream-out member of said transition chute and wherein said fill tube includes a divider for maintaining separation of said material portions within said tube.

8. The apparatus as described in claim 7 wherein said dividers of said transition chute and said fill tube are integral with one another.

9. The apparatus as described in claim 1 wherein said packaging means includes a package former for orienting packaging material about the exterior of said fill tube; a sealer for the timely sealing of selected portions of the packaging material; and a separator for separating filled packages from the bagging material.

10. The apparatus as described in claim 1 further comprising a bag catcher positioned below said fill tube for supporting the bagging material and for settling aligned materials within the package.

11. A packaging device for bulk materials comprised of a multiplicity of elongated pieces, said packaging device comprising:

means for weighing and apportioning selected amounts of said materials;

a transition chute for receiving said materials from said weighing means and guiding said materials to a fill tube, said chute provided with a stream-out member for substantially separating material pieces from one another and for causing free-fall of the pieces for substantial alignment thereof; and a fill tube provided with one or more dividers defining two or more fill chambers within said fill tube, each chamber having a top opening, the width of which is less than the average length of the elongated pieces comprising the bulk material to further align the bulk pieces exceeding the width of each of said openings.

12. The apparatus as described in claim 11 further comprising a bag catcher for supporting packaging material during the filling process and for settling the bulk materials within the packaging.

13. The apparatus as described in claim 11 wherein said stream-out member includes at least two vertically pivotal wings for separating said bulk material into two or more portions.

* * * * *